US006822401B2

(12) United States Patent
Borella et al.

(10) Patent No.: US 6,822,401 B2
(45) Date of Patent: Nov. 23, 2004

(54) FAULT MANAGEMENT METHOD FOR ELECTRONIC BALLAST

(75) Inventors: Flavia Borella, Santo Stefano Ticino (IT); Ugo Moriconi, Dalmine (IT); Albino Pidutti, Udine (IT); Roberto Quaglino, Biella (IT); Francesca Sandrini, Milan (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 10/057,003

(22) Filed: Jan. 24, 2002

(65) Prior Publication Data

US 2003/0006720 A1 Jan. 9, 2003

(30) Foreign Application Priority Data

Jan. 24, 2001 (IT) ..... PCT/IT01/00031

(51) Int. Cl.[7] ..... G05F 1/00; H05B 37/02
(52) U.S. Cl. ..... 315/291; 315/307
(58) Field of Search ..... 315/127, 224, 315/291, 308, 309, DIG. 5, DIG. 7

(56) References Cited

U.S. PATENT DOCUMENTS 4,375,608 A 3/1983 Kohler ..... 315/307
5,650,694 A * 7/1997 Jayaraman et al. ..... 315/225
5,945,788 A * 8/1999 Li et al. ..... 315/308
5,969,483 A * 10/1999 Li et al. ..... 315/225
5,998,930 A * 12/1999 Upadhyay et al. ..... 315/106
6,310,447 B1 * 10/2001 Krummel ..... 315/308
6,348,769 B1 * 2/2002 Pinchuk et al. ..... 315/307
6,400,095 B1 * 6/2002 Primisser et al. ..... 315/224
6,420,839 B1 * 7/2002 Chiang et al. ..... 315/311
6,501,225 B1 * 12/2002 Konopka ..... 315/105

FOREIGN PATENT DOCUMENTS

GB 2 269 279 A 2/1994
WO WO 00/24233 4/2000

* cited by examiner

*Primary Examiner*—James Vannucci
*Assistant Examiner*—Minh Dieu A
(74) *Attorney, Agent, or Firm*—Lisa K. Jorgenson; Harold H. Bennett, II; Seed IP Law Group PLLC

(57) ABSTRACT

A method manages lamp fault conditions in electronic ballasts for one or more gas discharge lamps. The method for fault management of electronic ballast for at least one gas discharge lamp includes the steps of: preheating the lamp filaments applying a low current for a predetermined time; igniting the lamp by increasing at a predetermined rate the voltage applied up to a predetermined strike value; monitoring the lamp current; repeating the steps of igniting the lamp and monitoring the lamp current for a predetermined numbers of times if the lamp current is over a predetermined threshold; and powering the lamp at normal operating conditions.

15 Claims, 5 Drawing Sheets

FAULT MANAGEMENT METHOD FOR ELECTRONIC BALLAST

BACKGROUND OF THE INVENTION

1. Field of the Invention

The present invention relates to the managing of lamp fault conditions in electronic ballasts for one or more gas discharge lamps.

2. Description of the Related Art

Electronic ballasts include an inverter, typically a half-bridge, for powering gas discharge lamps. The inverter provides a square wave output voltage, which switching frequency is imposed by the lamp controller. The square wave output voltage is processed by a resonant output circuit that provides low current to warm the filaments (high switching frequency), high voltage to ignite the lamps (shift from high to low switching frequency) and a controlled current to power the lamps. Phase sequences and management is driven by the lamp controller.

In electronic ballasts, protection circuits are implemented in order to protect the lamp from damage due to excessive voltage, current, and heat. When a fault condition occurs, the electronic ballast is shut down or shifted to a different mode of operation. Because spurious electrical noise or momentary variation in the lamp current or in the lamp characteristics may be mistakenly interpreted as a lamp fault condition, the electronic ballast would be shut down or shifted to a different mode of operation unnecessarily. Further, if the lamp does not ignite on the first attempt, the status is treated as a lamp fault condition. This fault condition does not consider that lamps under low temperature often ignite after repetitive ignition phases. Existing ballasts address this problem by employing "flasher" type protection circuits that periodically attempt to ignite the lamps. Flasher type circuits provide an indefinite number of ignition attempts and are therefore potentially useful for low-temperature starting. Unfortunately, flasher type protection circuits often produce sustained repetitive flashing in one or more lamps, a characteristic that has proven to be an annoyance to users/occupants. Old lamps are hard to ignite too, so only one ignition attempt could be insufficient to ignite the lamp.

In an electronic ballast there is the necessity to detect real fault conditions in different lamp phases (preheating, ignition and running phase). To have a more precision in detection, the protection circuits need a determined sensitivity corresponding to the phases to monitor.

All these additional functions have to be implemented in reduced dimensions and using few external components.

The patent U.S. Pat. No. 5,969,483 discloses a method for management of fault conditions. It offers immunity to electrical noise and disturbances, and provides multiple ignition attempts for igniting the lamps under low temperature conditions avoiding flashing of the lamps. This method consists in repeating preheating phase and frequency shift, whenever a lamp fault occurs. Because the preheating phase is usually long, the fault management action could be slow.

BRIEF SUMMARY OF THE INVENTION

In view of the state of the art described, an embodiment of the present invention provides a circuit able to avoid the drawback of the prior art.

An embodiment of the present invention is a method for fault management of electronic ballast for at least one gas discharge lamp comprising the steps of: preheating the lamp filaments by applying a low current for a predetermined time; igniting the lamp by increasing at a predetermined increasing rate the voltage applied up to a predetermined strike value; monitoring the lamp current; repeating the steps of igniting the lamp and monitoring the lamp current for a predetermined numbers of times if the lamp current is over a predetermined threshold; and powering the lamp at normal operating conditions.

BRIEF DESCRIPTION OF THE SEVERAL VIEWS OF THE DRAWING(S)

The features and the advantages of the present invention will be evident from the following detailed description, illustrated as a non-limiting example in the annexed drawings, wherein:

FIG. 1 shows a diagram of the variation of the frequency of a correct lamp turning on;

DETAILED DESCRIPTION OF THE INVENTION

Figure 1:
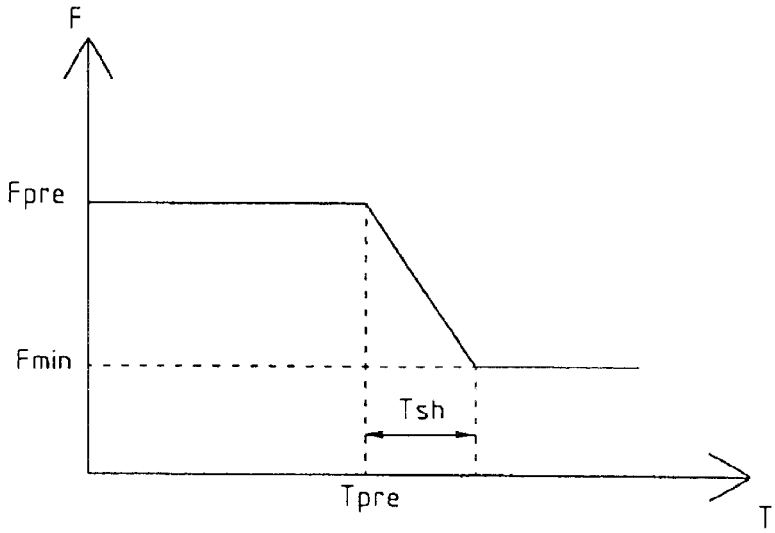

Referring now to FIG. 1, the decreasing rate of the frequency of a correct lamp turning on, is based on the preheating phase at high switching frequency Fpre for a predetermined time Tpre, that is applying a low current to the lamp, followed by the ignition phase, during which the frequency shifts down to the minimum switching frequency Fmin in a predetermined time Tsh, that is increasing at a predetermined rate the voltage across the lamp up to the necessary strike value. When the lamp strikes during ignition phase the lamp is running (normal lamp work).

A proposed method of lamp fault management distinguishes three different fault events: ignition fault; fault during normal lamp work; and lamp removal. Ignition fault means that the system has tried to ignite the lamp (with preheating phase followed by a ignition phase), but the lamp has not ignited. Fault during normal working means that for any reason a working lamp shuts down. The lamp removal condition implies a new start up of the electronic ballast, so the ballast normal turn on sequence is repeated.

Figure 2:
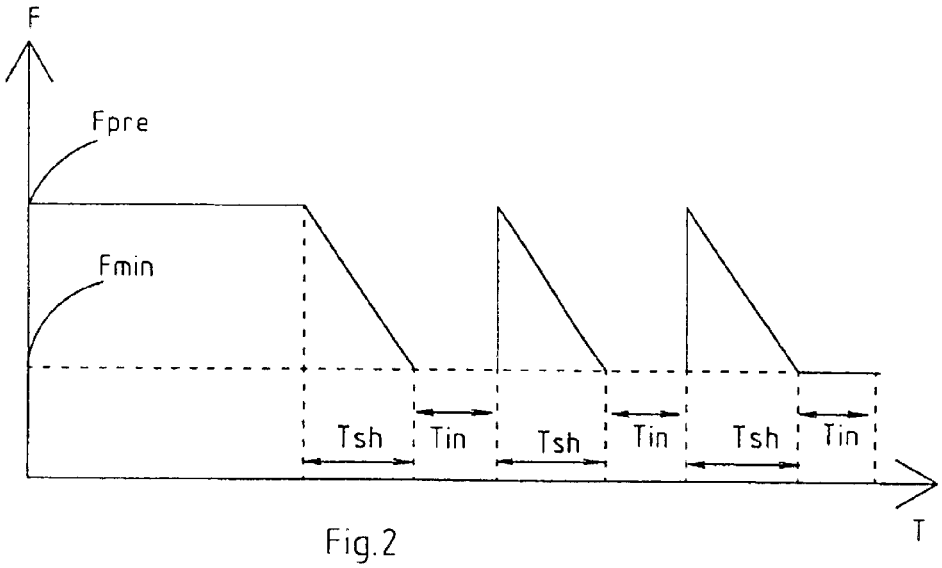
FIG. 2 shows a diagram of the variation of the frequency in the case a fault of turning on of the lamp.

According to an embodiment of the present invention, as is shown in FIG. 2, at the lamp lighting the lamp controller first warms the filaments driving the half bridge at a fixed and programmable frequency Fpre. This phase (preheating phase) goes on for a time period Tpre which length is programmable.

After that, the lamp controller shifts down the half bridge frequency, at the frequency Fmin, to attempt to ignite the lamp (frequency shift phase), for a time length Tsh programmable.

At the end of frequency shift, the lamp controller checks for lamp ignition, monitoring the lamp current cycle by cycle for a period Tmw. If the peak current is higher than a threshold up to a predetermined number of times, an ignition fault is detected, else the ignition has been successful and the controller drives the ballast in running phase.

In the case of ignition fault the lamp controller tries to re-ignite the lamp up to a predetermined number of times. It means that only the frequency shifting (ignition phase) and monitoring phases are repeated. There is not repetition of the preheating phase. To facilitate the lamp ignition, the proposed method repeats only the frequency shift and the monitoring phase, because the filaments are still warm. Usually the preheating phase is longer than the ignition plus monitoring phases (typically preheating is 2 seconds long, whereas ignition plus monitoring are 200 msec.); to avoid repetition of the preheating phase permit to speed up the attempt to turn on the lamp.

When the ignition fault has happened up to a predetermined number of time the lamp controller shut off the ballast definitively. So the system does not consume in fault condition.

In the case that lamp ignition happens before the predetermined numbers of faults has been reached, the lamp controller puts the ballast in running phase.

During running phase the controller checks continuously the current cycle by cycle and a running fault is detected, if the peak current becomes higher than a threshold up to a predetermined number of times. So the inverter sequences and fault management are the same as the first lighting case.

The case of lamp removal is treated by the lamp controller like a lamp lighting when a new lamp is set up. Accordingly, the phases sequences and fault treatment are the same as the lamp lighting case.

Figure 3:
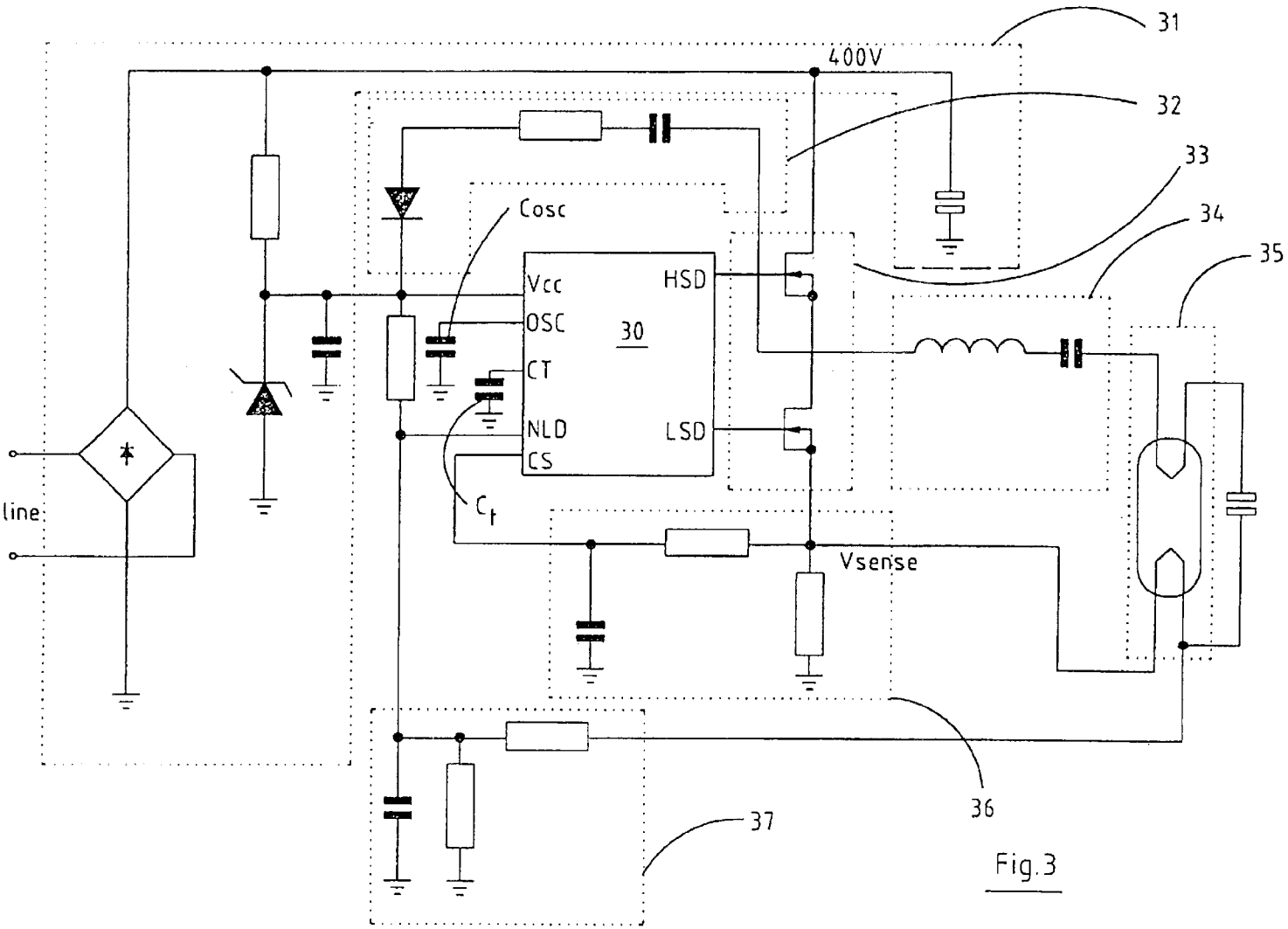
FIG. 3 shows a schematic diagram of an electronic ballast.

FIG. 3 shows a schematic diagram of an electronic ballast which is adapted for powering at least one gas discharge lamp 35 having a pair of heatable filaments. It comprises a lamp controller 30, which drives a half bridge 33, by means of the outputs HSD and LSD, in turn connected to a resonant output circuit 34 and therefore to the lamp 35. The lamp controller 30 has two terminals OSC and CT to which are connected respectively two capacitors Cosc and Ct, used for an oscillator and a timing circuit internal to the controller 30. The electronic ballast further comprises a power supply circuit 31 and a self-supply circuit 32 which provide a supply voltage to the lamp controller 30 at the terminal VCC. It also comprises a current detection circuit 36 which provide a signal to the terminal CS of the lamp controller 30; and a no-load detection circuit 37 which provide a signal to the terminal NLD of the lamp controller 30. The electronic ballast circuit is well know to the skilled in the art and will not be explained in detail.

Figure 4:
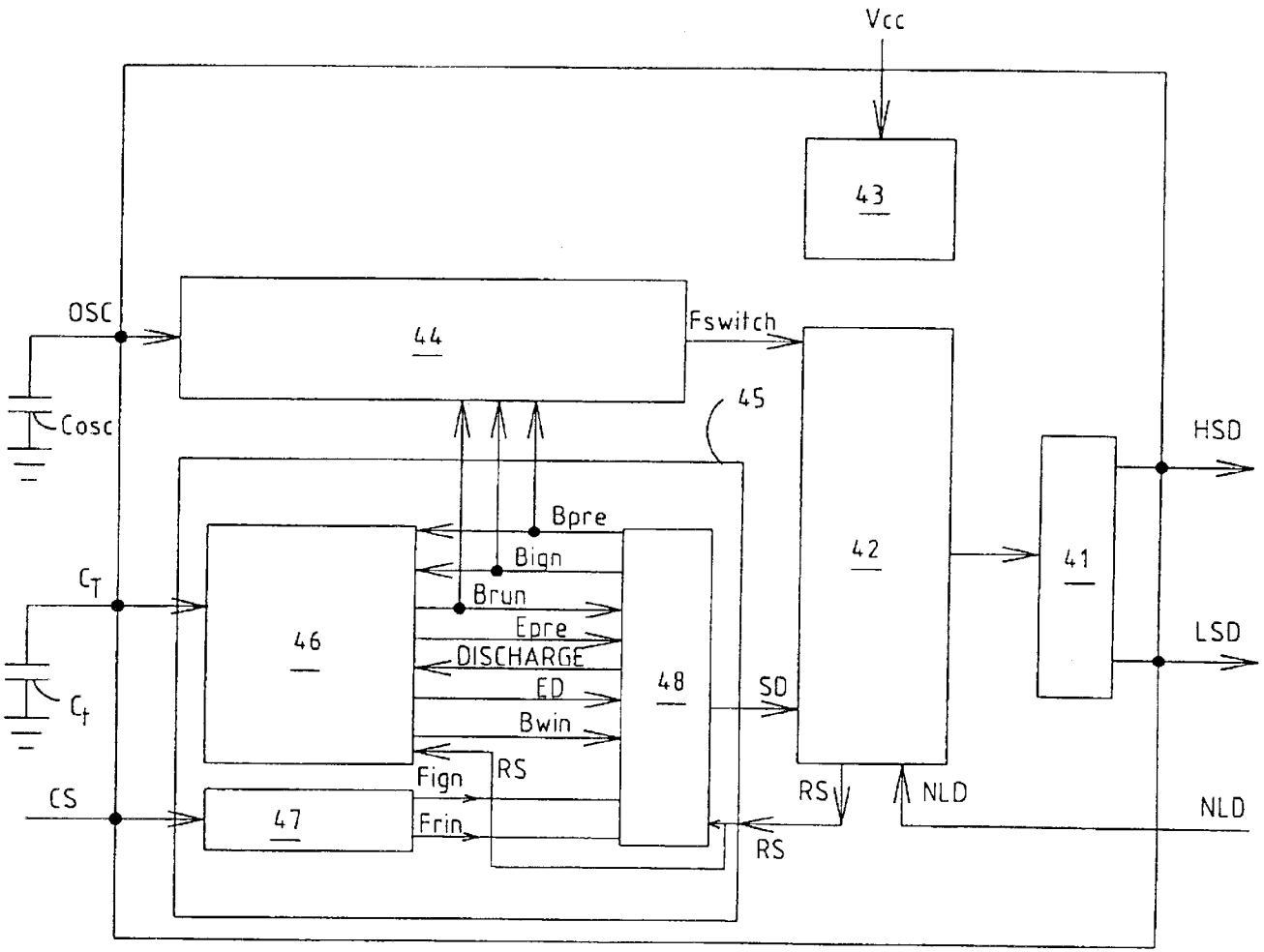
FIG. 4 shows a schematic diagram of a lamp controller of an electronic ballast.

The method is implemented in the lamp controller 30 and an exemplary schematic embodiment of the lamp controller 30 is shown in FIG. 4. It comprises a supply control 43 which supply all the circuits shown in figure (the connections are not shown). There is a controlled oscillator 44 with the terminal Osc connected to the capacitor Cosc which determine the oscillator frequency. The oscillator 44 receives the signals Brun (begin running), Bign (begin ignition) and Bpre (begin preheating) and provides as output the signal Fswitch connected to a control logic 42 which in turn drives the driver 41 providing the output HSD and LSD which drives the half bridge 33. The control logic 42 receives also as input a signal SD (shout down), an input NLD (no load detection) and provides as output a signal RS (reset). The circuit related to the lamp lighting sequence and fault management has the reference number 45. The lamp lighting sequence and fault management circuit 45 comprises a sensing circuit 47 having as input a signal CS provided by the current detection circuit 35 and output signals Fign (fault ignition) and Frun (fault running) which are provided to a protection circuit 48. The protection circuit 48 receives as input also the signals RS, Brun, Epre (end preheating), ED and Bwind (monitoring window), coming from a phase timing circuit 46. The protection circuit 48 provides as output the signal SD, provided to the control logic 42, the signals Bpre, Bign, DISCHARGE, provided to the timing circuit 46. The timing circuit 46 receives further the signal RS, and has a terminal CT to which is connected the capacitor Ct.

Figure 5:
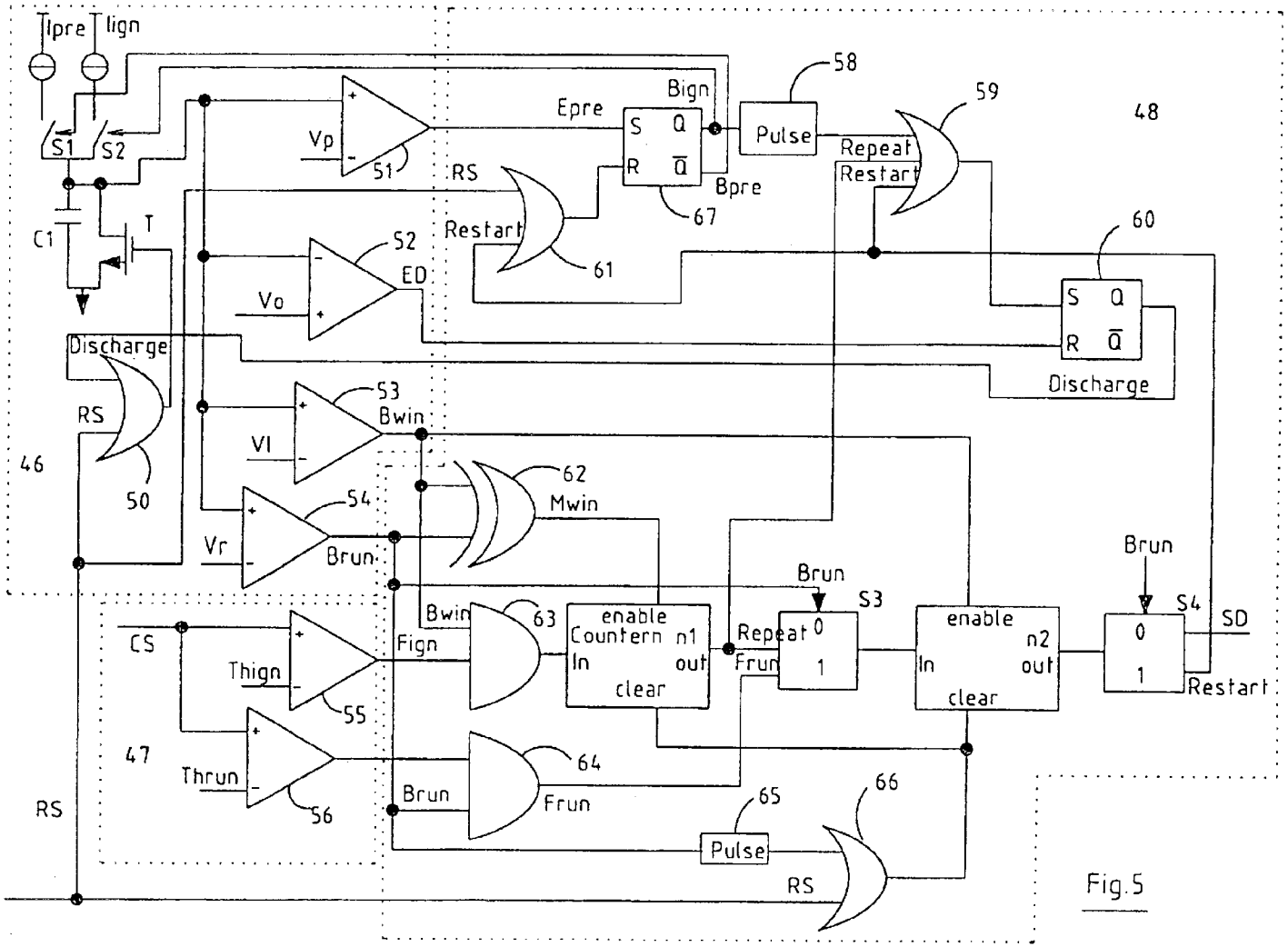
FIG. 5 shows a schematic diagram of a lamp lighting sequence and fault management circuit.

FIG. 5 shows a schematic diagram of the lamp lighting sequence and fault management circuit 45.

Two current generators Ipre and Iign controlled respectively by the switches S1 and S2 charge the capacitor Ct that can be discharged by the transistor T controlled by an OR circuit 50. The capacitor Ct is connected to the inputs of four comparators 51–54, which respectively compare the voltage Vct of the capacitor Ct with respectively the prefixed references voltages Vp, Vo, Vi and Vr. The reference voltages Vp, Vo, Vi and Vr represent respectively: Vp the end of the preheating phase; Vo the end of discharging Ct; Vi the end of the ignition phase and Vr the beginning of running phase (see FIG. 6).

Two other prefixed references voltages Thign and Thrun are applied to two comparators 55 and 56 which compare them with the voltage coming from from the current detection circuit 36 via the terminal CS and which is an indicator of the current in the half bridge circuit 33. The signal Epre at the output of the comparator 51 is connected to an S input of an SR flip-flop 57. The signal Bign at the output Q and the signal Bpre at the inverted output Q of the SR flip-flop 57 control respectively the switches S2 and S1. The signal Bign is also applied to a pulse circuit 58 which provides at an output a signal which is applied to an OR circuit 59. The OR circuit 59 receives as input also the signals REPEAT and RESTART. The output of the OR circuit 59 is applied to a S input of a SR flip-flop 60 having an output Q that produces a signal called DISCHARGE which is connected to an input of the OR circuit 50; the other input of the OR circuit 50 receives the signal RS that is the general reset coming from the control logic circuit 42. At the R input of the SR flip-flop 60 is applied the signal ED coming from the comparator 52. At the R input of the SR flip-flop 57 is applied the output of an OR circuit 61 which receives as input the signals RS and RESTART.

The comparator 53 provides a signal Bwin which is applied to an exclusive OR 62 together with the signal Brun provided by the comparator 54, and the exclusive OR 62 provides as output a signal Mwin (monitor window) which is applied to an input enable of a counter n1. The signal Bwin together to the signal coming from the comparator 55 are applied as input of an AND circuit 63 which output is connected to the in input of the counter n1. At the input clear of the counter n1 is applied the signal at the output of an OR circuit 66; the output of the counter n1 provides the signal REPEAT. The output of the comparator 56 together with the signal Brun are applied to an AND circuit 64 which provides as output the signal Frun which is applied together with the signal REPEAT to a switch S3 controlled by the signal Brun. If Brun is high, the switch S3 passes through the signal Frun; if Brun is low, the switch S3 passes through the signal REPEAT. Such a signal is applied to the in input of a counter n2, at the input enable of the counter n2 is applied the signal Bwin. The signal Brun is also applied to a pulse circuit 65 having an output that together with the signal RS are applied to an OR circuit 66 having an output that is connected to the clear input of the counter n2. The output of the counter n2 is applied to a switch S4 controlled by the signal Brun. If Brun is high the signal at the output of S4 is considered to be the signal RESTART, if Brun is low the signal at the output of S4 is considered to be the signal SD (shut down).

Figure 6:
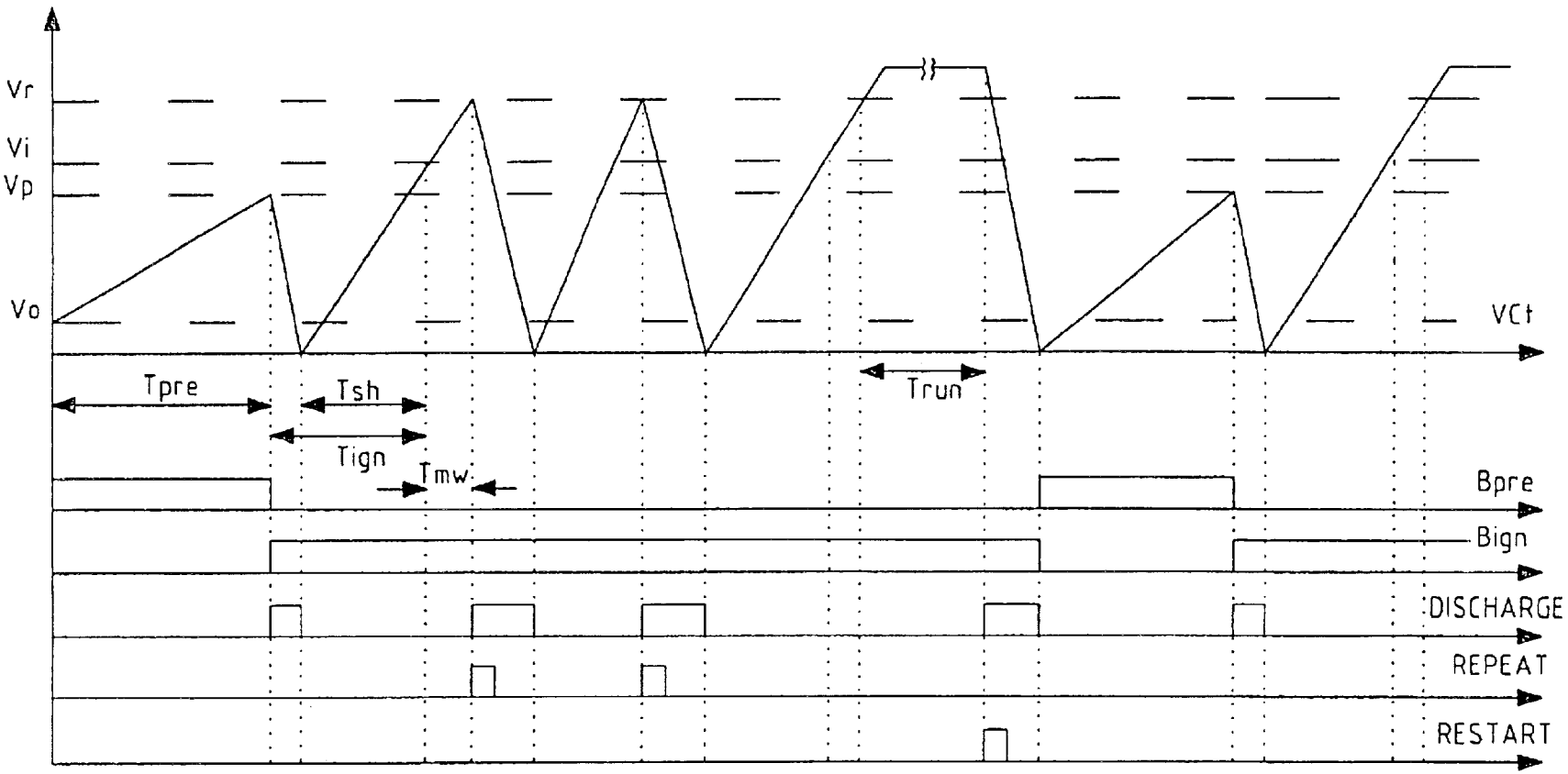
FIG. 6 shows a diagram of the behavior of some signal internal to the lamp lighting sequence and fault management circuit.

FIG. 6 shows a diagram of the behavior of some signals internal to the lamp lighting sequence and fault management circuit 45. In particular the variations of the voltage Vct at the terminal of the capacitor Ct varying some signals of the fault management circuit as Bpre, Bign, DISCHARGE, REPEAT and RESTART.

At the start up of the circuit, the reset pulse RS clears the counters, it assures Ct is discharged and it resets flip-flop 57: the signal Bpre (beginning of the preheating phase) is set high. Switch S1 is turned on and the current generator Ipre charges the capacitor Ct up to Vp.

Preheating goes on for period Tpre (see FIG. 6), during which the half bridge works at fixed preheating switching frequency, to warm the filaments.

When Tpre ends (Ct voltage is up to Vp), the signal Epre (end of preheating) goes high and sets (flip-flop 67) the signal Bign (beginning of the ignition): the ignition phase starts. Switch S1 is turned off, while switch S2 is turned on. The current generator Iign charges Ct, previously discharged by signal DISCHARGE. Signal DISCHARGE is set high by flip-flop 60 at the beginning of ignition phase. The set pulse of flip-flop 60 is a pulse corresponding to the rising edge of signal Bign and it is produced by the circuit pulse 58. Ignition phase ends when Ct voltage is up to Vi.

During ignition the switching frequency shifts from preheating switching frequency down to minimum switching frequency (frequency imposed for running). The frequency sweep goes on for period Tsh (shift time): the minimum frequency is reached when Ct voltage is up to Vi.

The charging of Ct from Vi to Vr causes xor gate 62 to determine a time window (Tmw, corresponding to Mwin signal), to monitor lamp current at minimum switching frequency. The lamp current reading occurs cycle by cycle and the information about it is the voltage drop on resistor Rsense (see FIG. 3). This information is brought to pin CS. If the cycle-by-cycle lamp current is higher than the maximum ignition current level during monitor window Tmw, the voltage drop on resistor Rsense, Vsense (at pin CS, FIG. 3), is up to ignition threshold Thign. It means the lamp does not ignite yet, even if the frequency sweep is completed. So comparator 55 output Fign (fault in ignition) goes high. Counter n1, which is enabled during monitor window Tmw, counts Fign pulses. When n1 Fign pulses occur in Tmw, counter n1 gives REPEAT pulse output, to discharge Ct and to repeat the ignition phase (frequency shift Tsh and monitor window Tmw). Counter n2, enabled at the beginning of the monitor window (Bwin) and active during monitor window and running phase, receives as input REPEAT pulses; switch S3 switches REPEAT pulses to counter n2 input during Tmw, that is before running phase starts (Brun, beginning of running, low). When n2 REPEAT pulses occur, counter n2 gives as output SD pulse (shut down pulse); it is because switch S4, in correspondence to S3, switches the counter n2 output to SD wire (Brun low). It means if n2 REPEAT pulses occur, the lamp has no more chance to attempt ignition and the ballast controller is shut down.

If the lamp ignites during the ignition phase, the running phase starts when Ct voltage reaches reference voltage Vr: the signal Brun (beginning of running) goes high. Switch S3 switches comparator 56 output to counter n2 input and switch S4 switches counter n2 output to RESTART wire. Counter n1 and counter n2 are reset by a pulse corresponding to the rising edge of signal Brun. If during the running phase the lamp current is higher than the maximum allowed running current, sense voltage Vsense (at pin CS) is up to run threshold Thrun and comparator 56 output Frun (fault in running) goes high. If sense voltage Vsense is up to Thrun n2 times, counter n2 gives a RESTART pulse and the circuit repeats the start up phases sequence: preheating phase, ignition phase (shift phase and monitor window).

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A method for fault management of an electronic ballast for a gas discharge lamp comprising the steps of:

preheating filaments of the lamp by applying a low current for a predetermined time;

igniting the lamp by increasing at a predetermined increasing rate a voltage applied to the lamp up to a predetermined ignition value;

monitoring a lamp current of the lamp;

if the lamp current is over a predetermined threshold, repeating the steps of igniting the lamp and monitoring the lamp current without repeating the preheating step; and powering the lamp at normal operating conditions.

2. A method for fault management of the electronic ballast according to claim 1 wherein in a case after having repeated the steps of igniting the lamp and monitoring the lamp current for a predetermined numbers of times the lamp does not work correctly, said electronic ballast is turned off.

3. A method for fault management of the electronic ballast according to claim 1 wherein the preheating, igniting, monitoring, repeating, and powering steps are performed in response to a fault during lamp working.

4. A method for fault management of the electronic ballast according to claim 3 wherein if the fault during lamp working occurs a predetermined number of times, said electronic ballast is turned off.

5. A method for fault management of the electronic ballast according to claim 1 wherein the preheating, igniting, monitoring, repeating, and powering steps are performed in response to a lamp removal.

6. A method for fault management of an electronic ballast for driving a gas discharge lamp at a drive frequency, comprising:

preheating filaments of the lamp by setting the drive frequency at a preheat frequency for a preheating period;

attempting to ignite the lamp by shifting the drive frequency from the preheat frequency to an operating frequency;

determining from a lamp current of the lamp whether the lamp has ignited within a predetermined ignition period; and in response to determining that the lamp has not ignited within the ignition period, re-attempting to ignite the lamp by shifting the drive frequency from the preheat frequency to the operating frequency without setting the drive frequency to the preheat frequency for the preheating period.

7. The method of claim 6, further comprising performing the determining and re-attempting steps a predetermined number of times, and turning off the electronic ballast if the lamp does not ignite within the predetermined number of times.

8. The method of claim 6 wherein the electronic ballast includes a drive circuit that drives the lamp and a controller that controls the drive circuit, the controller including a timing and protection circuit that supplies a begin-preheating signal to begin the preheating period, disables the begin-preheating signal to end the preheating signal, continuously supplies a begin-ignition signal during the ignition period and during the re-attempting step, and continues to disable the begin-preheating signal in response to determining that the lamp has not ignited within the ignition period.

9. The method of claim 8 wherein the timing and protection circuit includes a timing capacitor and a flip-flop having an input coupled to the timing capacitor, a first output that produces the begin-preheating signal, and a second output that produces the begin-ignition signal, the method further comprising charging the timing capacitor in response to receiving a reset signal, measuring a voltage across the timing capacitor, determining whether the voltage across the timing capacitor exceeds a threshold, and, in response to determining that the voltage across the timing capacitor exceeds the threshold, driving the first output into a disabled state and driving the second output into an enabled state.

10. The method of claim 9 wherein the timing and protection circuit includes first and second current generators coupled to the timing capacitor wherein the charging step includes charging the timing capacitor using the first current generator during the preheating period and charging the timing capacitor using the second current generator during the ignition period.

11. The method of claim 9 wherein the timing and protection circuit includes first and second switches connecting the timing capacitor to the first and second current generators, respectively, the first switch being controlled by the begin-preheating signal and the second switch being controlled by the begin-ignition signal such that the first and second switches are controlled alternatively.

12. An electronic ballast for a gas discharge lamp having a plurality of filaments, comprising:

means for preheating filaments of the lamp by setting the drive frequency at a preheat frequency for a preheating period;

means for attempting to ignite the lamp by shifting the drive frequency from the preheat frequency to an operating frequency;

means for determining from a lamp current of the lamp whether the lamp has ignited within a predetermined ignition period; and means for, in response to determining that the lamp has not ignited within the ignition period, re-attempting to ignite the lamp without setting the drive frequency at the preheat frequency for the preheating period.

13. A method for fault management of an electronic ballast for driving a gas discharge lamp at a drive frequency, comprising:

preheating filaments of the lamp by setting the drive frequency at a preheat frequency for a preheating period;

attempting to ignite the lamp by shifting the drive frequency from the preheat frequency to an operating frequency;

determining from a lamp current of the lamp whether the lamp has ignited within a predetermined ignition period;

in response to determining that the lamp has not ignited within the ignition period, re-attempting to ignite the lamp by repeating the attempting and determining steps;

wherein the electronic ballast includes a drive circuit that drives the lamp and a controller that controls the drive circuit, the controller including a timing and protection circuit that supplies a begin-preheating signal to begin the preheating period, disables the begin-preheating signal to end the preheating signal, continuously supplies a begin-ignition signal during the ignition period and during the re-attempting step, and continues to disable the begin-preheating signal in response to determining that the lamp has not ignited within the ignition period, and wherein the timing and protection circuit includes a timing capacitor and a flip-flop having an input coupled to the timing capacitor, a first output that produces the begin-preheating signal, and a second output that produces the begin-ignition signal; and charging the timing capacitor in response to receiving a reset signal;

measuring a voltage across the timing capacitor;

determining whether the voltage across the timing capacitor exceeds a threshold; and, in response to determining that the voltage across the timing capacitor exceeds the threshold, driving the first output into a disabled state and driving the second output into an enabled state.

14. The method of claim 13 wherein the timing and protection circuit includes first and second current generators coupled to the timing capacitor wherein the charging step includes charging the timing capacitor using the first current generator during the preheating period and charging the timing capacitor using the second current generator during the ignition period.

15. The method of claim 13 wherein the timing and protection circuit includes first and second switches connecting the timing capacitor to the first and second current generators, respectively, the first switch being controlled by the begin-preheating signal and the second switch being controlled by the begin-ignition signal such that the first and second switches are controlled alternatively.

* * * * *